US006715279B2

(12) United States Patent
White

(10) Patent No.: US 6,715,279 B2
(45) Date of Patent: Apr. 6, 2004

(54) APPARATUS FOR POSITIONING AN IGNITER WITHIN A LINER PORT OF A GAS TURBINE ENGINE

(75) Inventor: Tracy Lowell White, Fairfield, OH (US)

(73) Assignee: General Electric Company, Schenectady, NY (US)

( * ) Notice: Subject to any disclaimer, the term of this patent is extended or adjusted under 35 U.S.C. 154(b) by 72 days.

(21) Appl. No.: 10/090,192

(22) Filed: Feb. 4, 2002

(65) Prior Publication Data

US 2003/0163995 A1 Sep. 4, 2003

(51) Int. Cl.[7] ..... F02C 7/264
(52) U.S. Cl. ..... 60/39.821
(58) Field of Search ..... 60/39.821, 39.827, 60/39.828, 796, 798, 799, 800; 431/258

(56) References Cited

U.S. PATENT DOCUMENTS

| | | | | | |
|---|---|---|---|---|---|
| 2,941,363 | A | * | 6/1960 | Cuny et al. | 60/39.827 |
| 3,990,834 | A | | 11/1976 | DuBell et al. | 431/264 |
| 4,194,358 | A | | 3/1980 | Stenger | 60/39.06 |
| 4,215,979 | A | * | 8/1980 | Morishita | 60/39.827 |
| 4,216,651 | A | * | 8/1980 | Ormerod | 60/39.827 |
| 4,584,834 | A | * | 4/1986 | Koshoffer et al. | 60/39.821 |
| 4,593,340 | A | | 6/1986 | Meyer | 361/253 |
| 4,903,476 | A | | 2/1990 | Steber et al. | 60/39.32 |
| 5,129,231 | A | * | 7/1992 | Becker et al. | 60/754 |
| 5,421,158 | A | | 6/1995 | Stenger et al. | 60/747 |
| 6,286,302 | B1 | | 9/2001 | Farmer et al. | 60/39.55 |
| 6,557,350 | B2 | * | 5/2003 | Farmer et al. | 60/39.821 |

* cited by examiner

*Primary Examiner*—Michael Koczo
(74) *Attorney, Agent, or Firm*—William Scott Andes; James P. Davidson

(57) ABSTRACT

An igniter tube for a gas turbine engine combustor has an inner surface, an outer surface, and a longitudinal axis therethrough. More specifically, the igniter tube includes: a first portion positioned within a port of a liner for the combustor, the first portion having an inner surface with an inner diameter and an outer surface with an outer diameter; a second portion located adjacent the first portion, the second portion having an inner surface with an inner diameter and an outer surface with an outer diameter, wherein the second portion outer diameter increases from the first portion outer diameter at a first end to a predetermined outer diameter at a second end; and, a third portion located adjacent the second portion, the third portion having an inner surface with an inner diameter and an outer surface with an outer diameter, wherein the third portion outer diameter is substantially the same as the predetermined outer diameter. Moreover, the second portion inner diameter of the igniter tube is substantially equal to the first portion inner diameter and the third portion inner diameter of the igniter tube is greater than the inner diameter of the second portion.

23 Claims, 4 Drawing Sheets

APPARATUS FOR POSITIONING AN IGNITER WITHIN A LINER PORT OF A GAS TURBINE ENGINE

BACKGROUND OF THE INVENTION

The present invention relates generally to an igniter for a gas turbine engine and, in particular, to an apparatus for positioning an igniter within the liner port of a gas turbine engine.

It is well known for a gas turbine engine to employ an igniter in order to ignite a fuel/air mixture within its combustion system and produce the desired gases. Typically, the igniter is positioned in relative proximity to the fuel/air mixture exiting a mixing device through a port in the outer liner, which results in the igniter being projected into an area defining the primary combustion zone downstream of the mixing device. While various improvements have been made to the igniter itself and the cooling thereof (e.g., U.S. Pat. No. 3,990,834 to DuBell et al.), it will be understood that little has been accomplished with respect to the apparatus maintaining the igniter in position within a port in the outer liner of the gas turbine engine combustor.

Current devices utilized for this purpose have evolved from a simple tube into a hollow tube having a flange on top to prevent the igniter tube from entering the combustor flow path. Such flange may either be part of the tube or a cap plate welded onto a simple tube. Other igniter tubes have been utilized in conjunction with ferrules that have wear collars which extend below the sealing surface. To date, however, such igniter tubes generally have a single bore inner diameter.

One concern that has recently come to the attention of those in the art is the ability to inspect the weld joint connecting the igniter tube to the liner port. In particular, it has been found that axial clearance between the igniter tube and a cooling nugget for the liner needed to be increased to allow a line of sight inspection of such weld joint. Current specifications dictate that a clearance of at least 0.100 of an inch be provided to permit inspection by florescent penetration.

Additionally, igniter tubes have not provided any mechanism for preventing liberation of the igniter tube into the combustor flowpath in the event of a weld failure. It will be appreciated that absent such a mechanism, the igniter tube will simply slide inboard until a flange contacts the liner. This can cause the tip of the igniter to be shrouded by the igniter tube, thereby preventing normal operation of the igniter.

Similarly, it has also been found that the sealing flange of a ferrule utilized with the igniter tube has the possibility of wearing through, whereby the ferrule is then able to enter the combustor flowpath. At the same time, the use of a low profile ferrule, where the wear collar is located below the sealing surface with the igniter tube, is encouraged in order to promote greater clearance to the combustor casing.

Thus, in light of the foregoing, it would be desirable for an improved igniter tube for a gas turbine engine to be developed which permits greater axial clearance for line of sight inspection of the weld joint retaining such igniter tube to a liner port. It would also be desirable for such igniter tube to permit use of a low profile ferrule while providing positive retention features which prevent the igniter tube and ferrule from entering the combustor flow path.

BRIEF SUMMARY OF THE INVENTION

In a first exemplary embodiment of the invention, an igniter tube for a gas turbine engine combustor is disclosed as having an inner surface, an outer surface, and a longitudinal axis therethrough. More specifically, the igniter tube includes: a first portion positioned within a port of a liner for the combustor, the first portion having an inner surface with an inner diameter and an outer surface with an outer diameter; a second portion located adjacent the first portion, the second portion having an inner surface with an inner diameter and an outer surface with an outer diameter, wherein the second portion outer diameter increases from the first portion outer diameter at a first end to a predetermined outer diameter at a second end; and, a third portion located adjacent the second portion, the third portion having an inner surface with an inner diameter and an outer surface with an outer diameter, wherein the third portion outer diameter is substantially equal to the predetermined outer diameter. Moreover, the second portion inner diameter of the igniter tube is substantially equal to the first portion inner diameter and the third portion inner diameter of the igniter tube is greater than the inner diameter of the second portion.

In a second exemplary embodiment of the invention, an apparatus for positioning an igniter within a liner port of a gas turbine engine combustor is disclosed, wherein a longitudinal axis extends through the liner port. The apparatus includes a ferrule for receiving the igniter and an igniter tube connected to the liner port. The ferrule further includes a first portion, a wear collar extending from the first portion generally parallel to the longitudinal axis, and a sealing flange extending substantially perpendicular to the longitudinal axis. The igniter tube further includes: a first portion positioned within the liner port, the first portion having an inner surface with an inner diameter and an outer surface with an outer diameter; a second portion located adjacent the first portion, the second portion having an inner surface with an inner diameter and an outer surface with an outer diameter, wherein the second portion inner diameter is substantially equal to the first portion inner diameter; and, a third portion located adjacent the second portion, the third portion having an inner surface with an inner diameter and an outer surface with an outer diameter, wherein the third portion inner diameter is greater than the first and second portion inner diameters. The ferrule wear collar extends into the igniter tube third portion and is able to move substantially perpendicular to the longitudinal axis a predetermined amount.

In a third exemplary embodiment of the invention, an apparatus for positioning an igniter within a liner port of a gas turbine engine combustor is disclosed, wherein a longitudinal axis extends through the liner port. The apparatus includes a ferrule for receiving the igniter and an igniter tube connected to the liner port. The ferrule further includes a first portion, a wear collar extending from the upper portion generally parallel to the longitudinal axis, and a sealing flange extending substantially perpendicular to the longitudinal axis. The igniter tube further includes: a first portion positioned within the liner port, the first portion having an inner surface with an inner diameter and an outer surface with an outer diameter; a second portion located adjacent the first portion, the second portion having an inner surface with an inner diameter and an outer surface with an outer diameter, wherein the second portion outer diameter increases from the first portion outer diameter at a first end to a predetermined outer diameter at a second end; and, a third portion located adjacent the second portion, the third portion having an inner surface with an inner diameter and an outer surface with an outer diameter, wherein the third portion outer diameter is substantially equal to the predetermined outer diameter. The predetermined outer diameter of the second and third igniter tube portions is greater than a diameter of the liner port so as to prevent the igniter tube from extending therethrough past a predetermined distance.

DETAILED DESCRIPTION OF THE INVENTION

Figure 1:
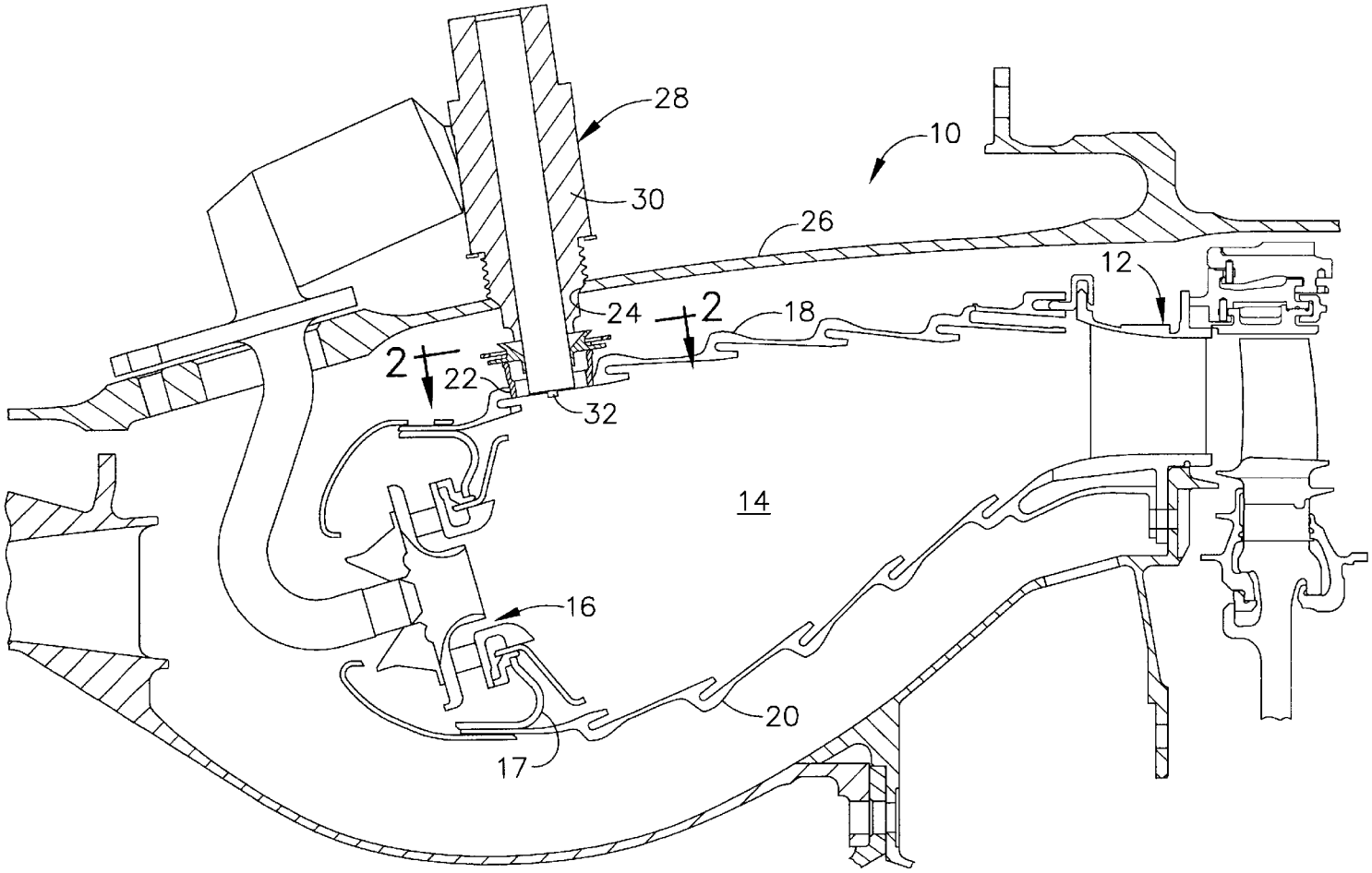
FIG. 1 is a cross-sectional view of a gas turbine engine including an igniter and the apparatus for positioning it within a combustor liner thereof in accordance with the present invention.
Figure 2:
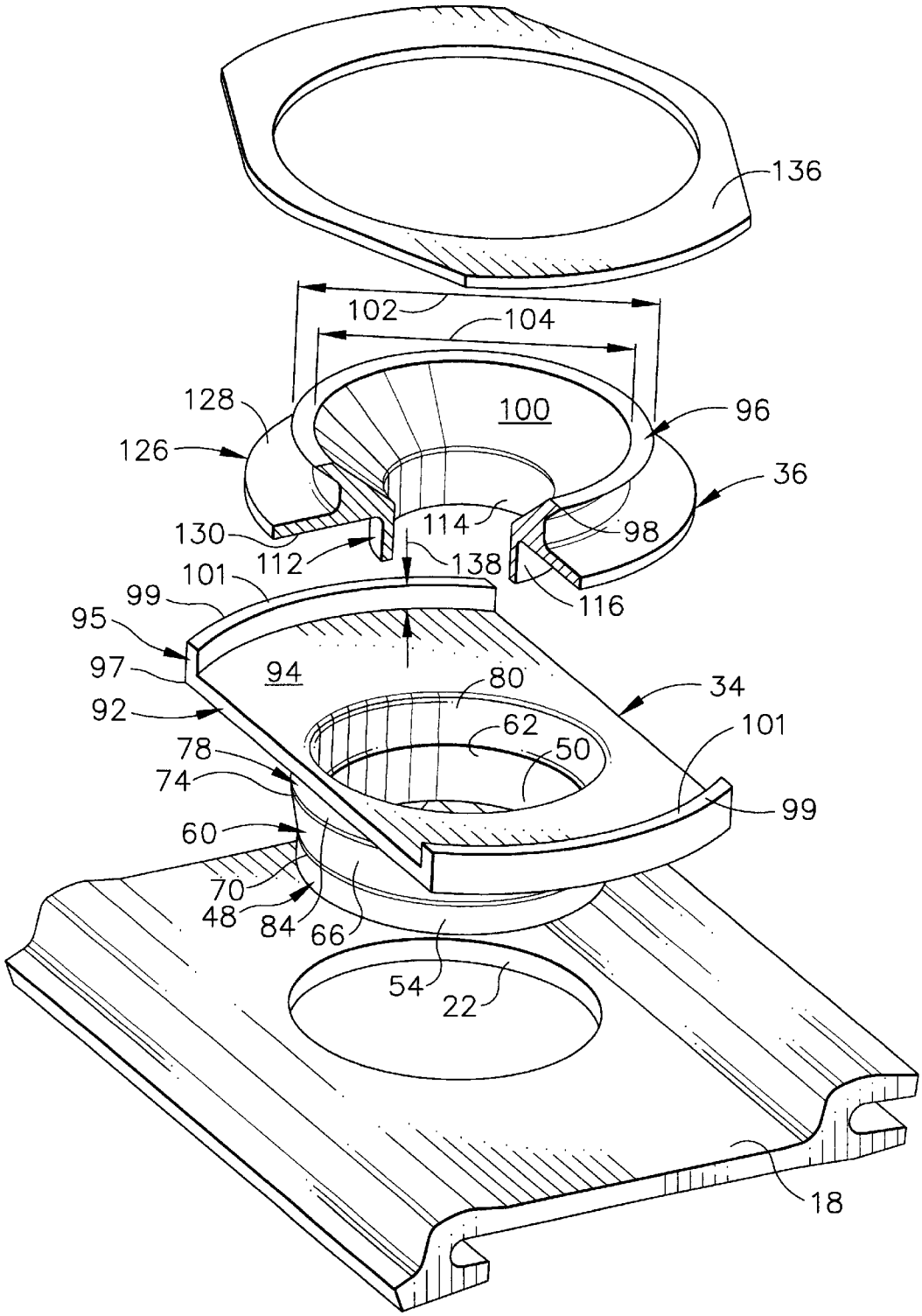
FIG. 2 is an exploded perspective view of the apparatus depicted in FIG. 1.

Referring now to the drawings in detail, wherein identical numerals indicate the same elements throughout the figures, FIG. 1 depicts a combustor 10 of a gas turbine engine. It will be appreciated that combustor 10 conventionally generates combustion gases that are discharged therefrom through a high pressure turbine nozzle assembly 12, from which the combustion gases are channeled to a conventional high pressure turbine and, in turn, to a conventional low pressure turbine. In particular, a fuel/air mixture is provide to a combustion chamber 14 of combustor 10 by means of a mixing device 16. Combustion chamber 14 is generally defined by a dome portion 17 at an upstream end, an outer liner 18, and an inner liner 20.

It will be seen that a port 22 in outer liner 18 and an opening 24 in casing 26 are provided so that an igniter assembly, identified generally by numeral 28, is positioned at an upstream end of combustion chamber 14. In this way, igniter assembly 28 is able to ignite the fuel/air mixture entering combustion chamber 14 so that combustion gases are produced therein. Igniter assembly 28 includes an igniter 30 having a tip portion 32 which extends into combustion chamber 14. It will be understood that igniter tip portion 32 may be heated by electrical discharge or other similar and typical fuel igniting phenomenon.

Figure 4:
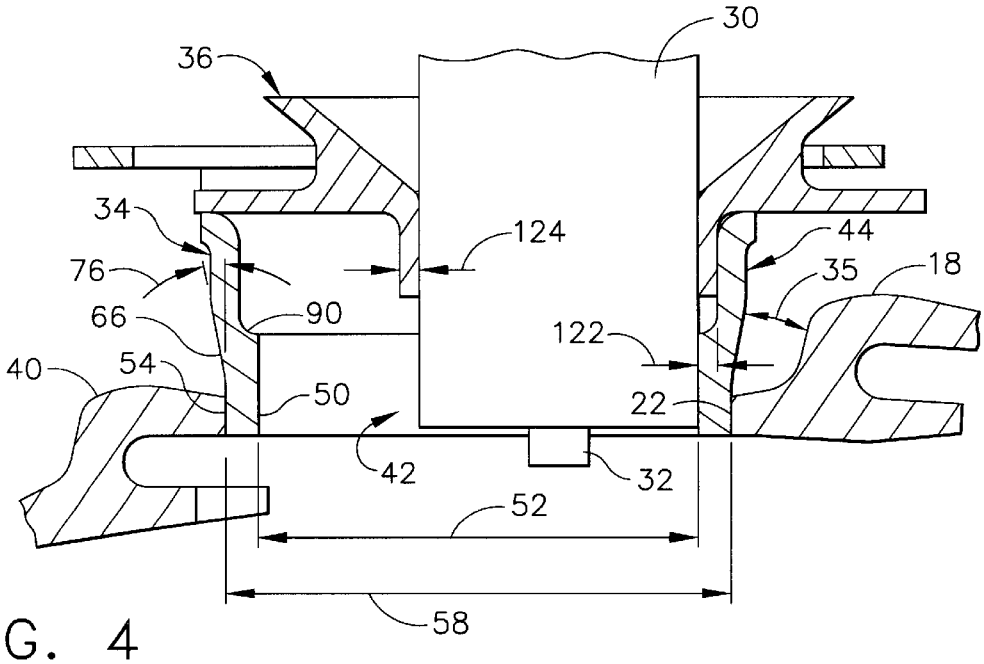
FIG. 4 is an enlarged, sectional view of the apparatus depicted in FIGS. 1–3, where the ferrule has shifted laterally within the igniter tube.

With respect to the present invention, an apparatus including an igniter tube 34 and a ferrule 36 is provided to position and align igniter 30 within liner port 22. Igniter tube 34, which is preferably connected to liner port 22 by means of weld joint 38, is configured so as to permit line of sight inspection of weld joint 38 between an adjacent cooling nugget 40 of outer liner 18 and igniter tube 34. Current specifications dictate that an axial clearance (identified as a space 35 in FIG. 4 between igniter tube 34 and outer liner 18) of at least 0.100 of an inch be provided.

Figure 3:
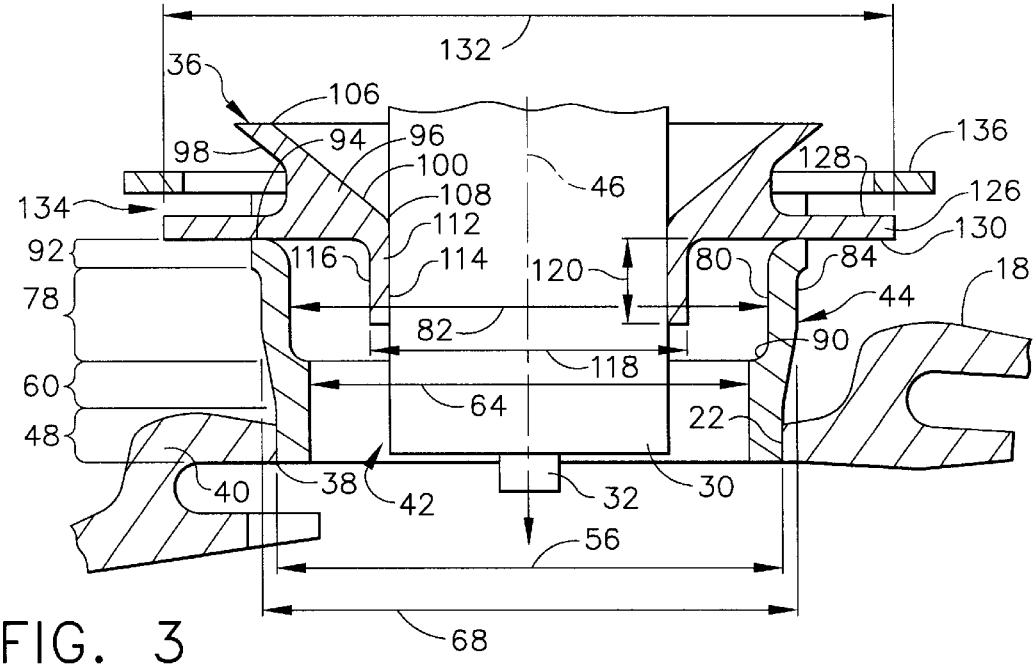
FIG. 3 is an enlarged, sectional view of the apparatus depicted in FIGS. 1 and 2.

More specifically, it will be seen in FIG. 3 that igniter tube 34 generally has an inner surface 42, an outer surface 44, and a longitudinal axis 46 extending therethrough. It will be understood that longitudinal axis 46 also extends through liner port 22. Igniter tube 34 further includes a first portion 48 located within and adjacent to liner port 22. First igniter tube portion 48 has an inner surface 50 with an inner diameter 52 and an outer surface 54 with an outer diameter 56. Of course, outer diameter 56 of first igniter portion 48 preferably is substantially the same as the diameter 58 of liner port 22 so that it is easily welded thereto.

Igniter tube 34 includes a second portion 60 located adjacent to first igniter tube portion 48, where second igniter tube portion 60 has an inner surface 62 with an inner diameter 64 and an outer surface 66 with an outer diameter 68. It will be appreciated that second portion outer diameter 68 preferably increases from first portion outer diameter 58 at a first end 70 to a predetermined outer diameter at a second end 74. Accordingly, second portion outer surface 66 generally has a flared appearance and preferably extends at an angle 76 to first portion outer surface 54 in a range of approximately 5–25° (see FIG. 4). A more preferred range for angle 76 is approximately 9–21° and the most preferred range is approximately 12–16°. Inner diameter 64 of second igniter tube portion 60 preferably is substantially equal to inner diameter 52 of first igniter tube portion 48.

Figure 5:
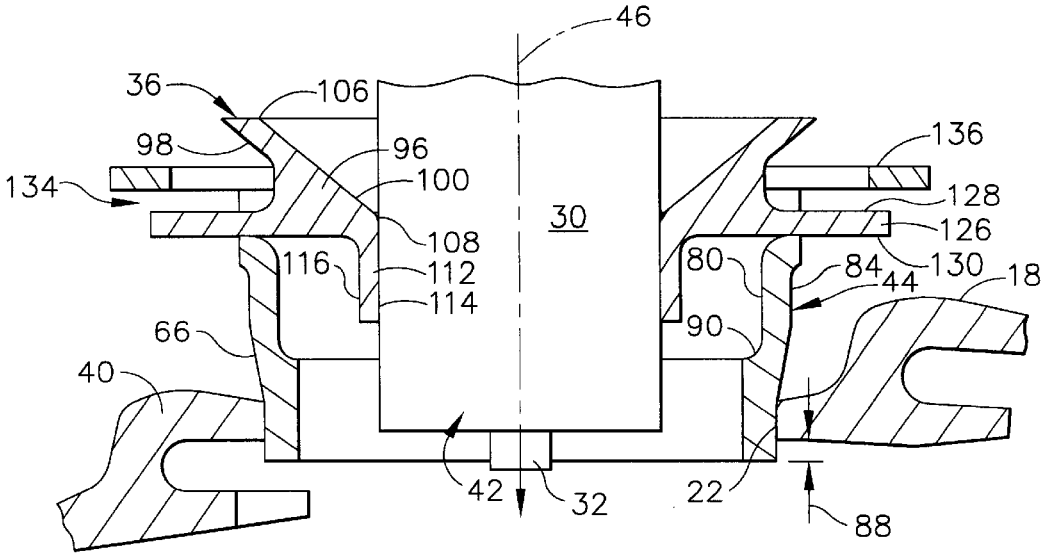
FIG. 5 is an enlarged, sectional view of the apparatus depicted in FIGS. 1–4, where the weld joint with the liner port has failed and the igniter tube has moved along the longitudinal axis to an inboard position; and, FIG. 6 is an enlarged, sectional view of the apparatus depicted in FIGS. 1–5, where the sealing flange of the ferrule has worn through and is retained within the igniter tube.

A third portion 78 is located adjacent to second igniter tube portion 60 and likewise has an inner surface 80 with an inner diameter 82 and an outer surface 84 with an outer diameter 86. It will be noted that outer diameter 86 of third igniter tube portion 78 is substantially constant and substantially equal to a maximum second portion outer diameter 68. The maximum outer diameter of outer surface 66 for second igniter tube portion 60 preferably is greater than diameter 58 of liner port 22 so as to prevent igniter tube 34 from extending inboard therethrough past a predetermined distance 88 should weld joint 38 fail (see FIG. 5). In particular, igniter tube 34 preferably will not move along longitudinal axis 46 more than about one-third to about one-half the axial length of second igniter tube portion 60, but outer diameter 68 acts as a failsafe against igniter tube 34 moving axially past second igniter tube portion 60. Another way of defining predetermined distance 88 is that igniter tube 34 will be prevented from moving axially into a position where igniter tip portion 32 is shrouded thereby so that normal operation of igniter 30 is maintained.

Inner diameter 82 of third igniter tube portion 78 preferably is greater than inner diameter 64 of second igniter tube portion 60, and a surface 90 is provided so as to transition between inner surface 62 of second igniter tube portion 60 and inner surface 80 of third igniter tube portion 78.

Igniter tube 34 preferably includes a fourth portion 92 located adjacent to third igniter tube portion 78 which extends substantially perpendicular to longitudinal axis 46. It will be seen that fourth igniter tube portion 92 appears as a flange which extends at an angle to first igniter tube portion 48, second igniter tube portion 60, and third igniter tube portion 78, respectively. An upper surface 94 of fourth igniter tube portion 92 is utilized as a sealing surface with ferrule 36 as described in greater detail hereinbelow.

Igniter tube 34 also preferably includes a fifth portion 95 extending from a distal end 97 of said fourth igniter tube portion 92. It will be appreciated from FIG. 3 that fifth igniter tube portion 95 need not extend around ferrule sealing flange 126 in an uninterrupted, 360° manner. Rather, fifth igniter tube portion 95 may be configured to have a plurality of arcuate segments 99 ranging from approximately 30–90° in length. It will be seen that each of arcuate segments 99 includes an upper surface 101 to which a retainer 136 may be attached for securing ferrule 36 in position with igniter tube 34. By employing a pair of arcuate segments at opposite ends of igniter tube 34, fourth igniter tube portion 92 need not extend so far all the way around igniter tube 34. Thus, fourth igniter tube portion 92 and retainer 136 are not necessarily circular, which helps in reducing the amount of material required (and their respective weight) for such items.

With regard to ferrule 36 discussed hereinabove, it will be seen that such ferrule 36 includes a first portion 96 for receiving igniter 30. First ferrule portion 96 preferably has a frusto-conical shape so that an outer surface 98 and an inner surface 100 decrease in diameter 102 and 104, respectively, from a first end 106 to a second end 108. It will be appreciated, however, that outer diameter 102 of first ferrule portion 96 has a maximum diameter 110 that is greater than inner diameter 82 of third igniter tube portion 78 in order to provide physical interference against ferrule first portion 96 from entering combustion chamber 14 via igniter tube 34.

A wear collar 112 is located adjacent to and extends from first ferrule portion 96 generally parallel to longitudinal axis 46. Wear collar 112 is tubular in configuration and has an inner surface 114 and an outer surface 116. It will be seen that wear collar 112 preferably has an outer diameter 118 less than inner diameter 82 of third igniter tube portion 78, as well as an axial length 120 less than an axial length of third igniter tube portion 78, so that wear collar 112 is able to be positioned therein in a low profile configuration. It will further be noted that wear collar 112 is able to move substantially perpendicular to longitudinal axis 46 within third igniter tube portion 78, but preferably is limited in such movement so that inner surface 114 thereof does not extend beyond (outside of) inner surface 62 of second igniter tube portion 60 (see FIG. 4). In this way, igniter 30 is maintained in a position substantially parallel to longitudinal axis 46. One manner of providing this limitation is to configure igniter tube 34 so that transition surface 90 between inner surfaces 62 and 80 of second and third igniter portions 60 and 78, respectively, has a radial length 122 no greater than a thickness 124 of wear collar 112.

Figure 6:
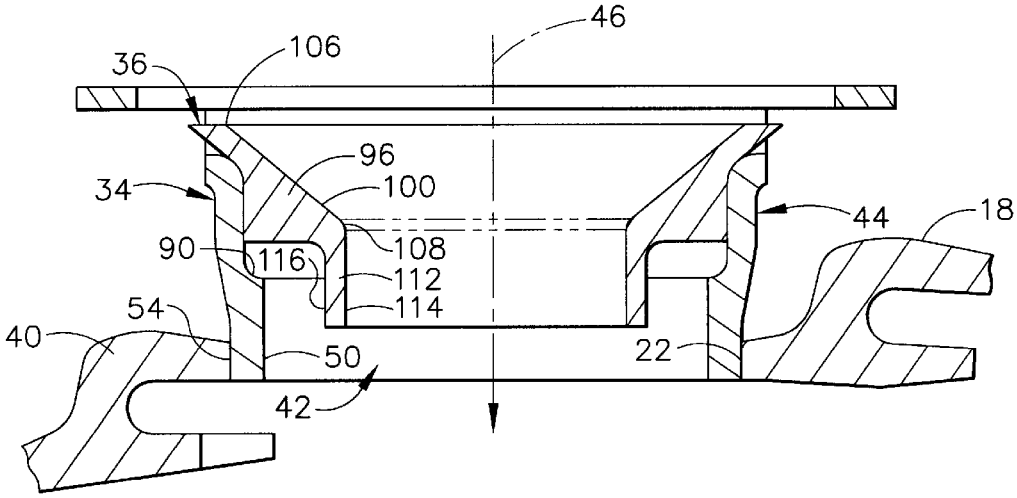

Ferrule 36 also preferably includes a sealing flange 126 which extends substantially perpendicular to longitudinal axis 46 and has an upper surface 128 and a lower surface 130. It will be appreciated that sealing flange 126 rests upon upper surface 94 of fourth igniter tube portion 92 so as to provide a sealing surface therebetween which permits some sliding of ferrule 36 in a direction substantially perpendicular to longitudinal axis 46. Sealing flange 126 is located axially on ferrule 36 approximately at the junction of ferrule first portion 96 and wear collar 112, and serves to increase the overall diameter 132 of ferrule 36. This prevents axial movement of ferrule 36 into igniter tube 34. Ferrule 36 is permitted to move a slight amount axially above fourth igniter tube portion 92 due to a gap 134 between sealing flange upper surface 128 and retainer 136 which is equivalent to a height 138 of fifth igniter tube portion 95. Even should sealing flange 126 experience a wear problem, whereby ferrule 36 is able to move within igniter tube 34 toward combustion chamber 14, the counterbore configuration provided by the reduced inner diameter 64 of second igniter tube portion 60 from inner diameter 82 of third igniter tube portion 78 prevents ferrule 36 from creating domestic object damage by entering combustion chamber 14 (see FIG. 6).

Having shown and described the preferred embodiment of the present invention, further adaptations of igniter tube 34 and ferrule 36 can be accomplished by appropriate modifications by one of ordinary skill in the art without departing from the scope of the invention.

What it claimed is:

1. An igniter tube for a gas turbine engine combustor, said igniter tube having an inner surface, an outer surface, and a longitudinal axis therethrough, comprising:

(a) a first portion positioned within a port of a liner for said combustor, said first portion having an inner surface with an inner diameter and an outer surface with an outer diameter;

(b) a second portion located adjacent said first portion, said second portion having an inner surface with an inner diameter and an outer surface with an outer diameter, wherein said second portion outer diameter increases from said first portion outer diameter at a first end to a predetermined outer diameter at a second end; and, (c) a third portion located adjacent said second portion, said third portion having an inner surface with an inner diameter and an outer surface with an outer diameter, wherein said third portion outer diameter is substantially equal to said predetermined outer diameter.

2. The igniter tube of claim 1, further comprising a fourth portion located adjacent said third portion, said fourth portion extending substantially perpendicular to said longitudinal axis.

3. The igniter tube of claim 2, further comprising a fifth portion extending from a distal end of said fourth portion substantially parallel to said longitudinal axis.

4. The igniter tube of claim 1, wherein said second portion inner diameter is substantially equal to said first portion inner diameter.

5. The igniter tube of claim 1, wherein said third portion inner diameter is greater than the inner diameter of said second portion.

6. The igniter tube of claim 5, further comprising a surface transitioning between said second portion inner surface to said third portion inner surface.

7. The igniter tube of claim 1, said second portion outer surface extending at an angle to said first portion outer surface in a range of approximately 5–25°.

8. The igniter tube of claim 1, said first portion outer diameter being substantially equal to a diameter of said liner port.

9. The igniter tube of claim 8, said predetermined outer diameter of said second and third portions being greater than said liner port diameter so as to prevent said igniter tube from extending therethrough past a predetermined distance.

10. The igniter tube of claim 1, wherein a space between said liner and said second portion is at least a predetermined amount.

11. An apparatus for positioning an igniter within a liner port of a gas turbine engine combustor, wherein a longitudinal axis extends through said liner port, said apparatus comprising:

(a) a ferrule for receiving said igniter, comprising:
  (1) a first portion;
  (2) a wear collar extending from said first portion generally parallel to said longitudinal axis; and
  (3) a sealing flange extending substantially perpendicular to said longitudinal axis; and (b) an igniter tube connected to said liner port, comprising:
  (1) a first portion positioned within said liner port, said first portion having an inner surface with an inner diameter and an outer surface with an outer diameter;
  (2) a second portion located adjacent said first portion, said second portion having an inner surface with an inner diameter and an outer surface with an outer diameter, wherein said second portion inner diameter is substantially equal to said first portion inner diameter; and (3) a third portion located adjacent said second portion, said third portion having an inner surface with an inner diameter and an outer surface with an outer diameter, wherein said third portion inner diameter is greater than said first and second portion inner diameters;

wherein said ferrule wear collar extends into said igniter tube third portion and is able to move substantially perpendicular to said longitudinal axis a predetermined amount.

12. The apparatus of claim 11, said igniter tube further comprising a fourth portion located adjacent said third portion, said fourth portion extending substantially perpendicular to said longitudinal axis so that said ferrule sealing flange interfaces therewith.

13. The apparatus of claim 12, said igniter tube further comprising a fifth portion extending from a distal end of said fourth portion substantially parallel to said longitudinal axis.

14. The apparatus of claim 13, further comprising a retainer attached to said igniter tube fifth portion for securing said ferrule in position with said igniter tube.

15. The apparatus of claim 11, said igniter tube further comprising a surface transitioning between said second portion inner surface and said third portion inner surface, wherein said transition surface serves to prevent said ferrule from moving parallel to said longitudinal axis more than a predetermined amount.

16. The apparatus of claim 15, wherein said transition surface has a radial length no greater than a thickness of said ferrule wear collar.

17. The apparatus of claim 11, said igniter tube second portion having an outer diameter which increases from said first portion outer diameter at a first end to a predetermined outer diameter at a second end.

18. The apparatus of claim 17, said igniter tube third portion having an outer diameter substantially equal to said predetermined outer diameter.

19. The apparatus of claim 17, wherein said predetermined outer diameter is greater than a diameter of said liner port so as to prevent said igniter tube from extending therethrough past a predetermined distance.

20. The apparatus of claim 11, wherein a space between said liner and said igniter tube second portion is at least a predetermined amount.

21. The apparatus of claim 11, said ferrule upper portion having an outer diameter greater than said inner diameter of said igniter tube third portion.

22. The apparatus of claim 11, wherein an axial length of said igniter tube third portion is greater than an axial length of said ferrule wear collar.

23. An apparatus for positioning an igniter within a liner port of a gas turbine engine combustor, wherein a longitudinal axis extends through said liner port, said apparatus comprising:

(a) a ferrule for receiving said igniter, comprising:

(1) a first portion;

(2) a wear collar extending from said upper portion generally parallel to said longitudinal axis; and (3) a sealing flange extending substantially perpendicular to said longitudinal axis; and (b) an igniter tube connected to said liner port, comprising:

(1) a first portion positioned within said liner port, said first portion having an inner surface with an inner diameter and an outer surface with an outer diameter;

(2) a second portion located adjacent said first portion, said second portion having an inner surface with an inner diameter and an outer surface with an outer diameter, wherein said second portion outer diameter increases from said first portion outer diameter at a first end to a predetermined outer diameter at a second end; and (3) a third portion located adjacent said second portion, said third portion having an inner surface with an inner diameter and an outer surface with an outer diameter, wherein said third portion outer diameter is substantially equal to said predetermined outer diameter;

wherein said predetermined outer diameter of said second and third igniter tube portions is greater than a diameter of said liner port so as to prevent said igniter tube from extending therethrough past a predetermined distance.

* * * * *